US005116182A

United States Patent [19]

Lin

[11] Patent Number: 5,116,182

[45] Date of Patent: May 26, 1992

[54] AUTOMATIC CAR PARKING SYSTEM

[76] Inventor: Bao N. Lin, No. 441, Jen AI Rd., Chu Tung Town, Hsin Chu Hsien, Taiwan

[21] Appl. No.: 598,969

[22] Filed: Oct. 17, 1990

[51] Int. Cl.[5] ..... E04H 6/06

[52] U.S. Cl. ..... 414/254; 414/264; 414/282

[58] Field of Search ..... 414/227, 253, 254, 255, 414/256, 264, 282

[56] References Cited

U.S. PATENT DOCUMENTS

| | | | |
|---|---|---|---|
| 1,584,080 | 5/1926 | Dinkelberg | 414/255 X |
| 2,752,051 | 6/1965 | Strahm et al. | 414/254 |
| 2,840,248 | 6/1958 | Gear et al. | 414/256 |
| 2,923,421 | 2/1960 | DeSenigon De Ramfort | 414/254 X |
| 2,945,604 | 7/1960 | Kroll et al. | 414/254 |
| 3,161,303 | 12/1964 | Burrows | 414/254 |
| 3,618,793 | 11/1971 | Coursey | 414/254 X |
| 3,896,955 | 7/1975 | Collins et al. | 414/254 |

FOREIGN PATENT DOCUMENTS

| | | | |
|---|---|---|---|
| 2757755 | 6/1978 | Fed. Rep. of Germany | 414/254 |

*Primary Examiner*—Robert J. Spar
*Assistant Examiner*—Robert S. Katz
*Attorney, Agent, or Firm*—Morton J. Rosenberg; David I. Klein

[57] ABSTRACT

An automatic car parking system comprised of a parking rack and at least one car lifting feeder. The parking rack is divided into a plurality of parking spaces. The car lifting feeder has a pair of comb-like wings for carrying a car into a pair of comb-like platforms which are made on each parking space in the parking rack.

3 Claims, 9 Drawing Sheets

AUTOMATIC CAR PARKING SYSTEM

BACKGROUND OF THE INVENTION

The present invention is related to an automatic type of car parking system which is comprised of parking rack and car lifting feeder for automatically carrying motorcars into parking spaces by means of the operation of a pair of comb-like wings matching with each pair of comb-like platforms on each parking space.

In downtown area, because of very expensive land price, it is very difficult to build sufficient, one-dimensional parking lots for parking motor vehicles. In order to fully utilize the limited land space, high-raised, multi-deck type of parking lot is a good way to park motor vehicles into spaces with minimized land space occupation. The present invention is to provide an automatic car parking system which can automatically carry motor vehicles into parking spaces and greatly reduce land space occupation.

SUMMARY OF THE INVENTION

The present invention is to provide an automatic car parking system for automatically parking motorcars with minimized space occupation, which is comprised of a parking rack and at least one car lifting feeder. The parking rack is divided into a plurality of parking spaces. The car lifting feeder has a pair of comb-like wings for carrying a car into a pair of comb-like platforms which are made on each parking space in the parking rack.

BRIEF DESCRIPTION OF THE DRAWINGS

The present invention will now be described by way of example, with reference to the annexed drawings, in which.

DETAILED DESCRIPTION OF THE PREFERRED EMBODIMENTS

Figure 1:
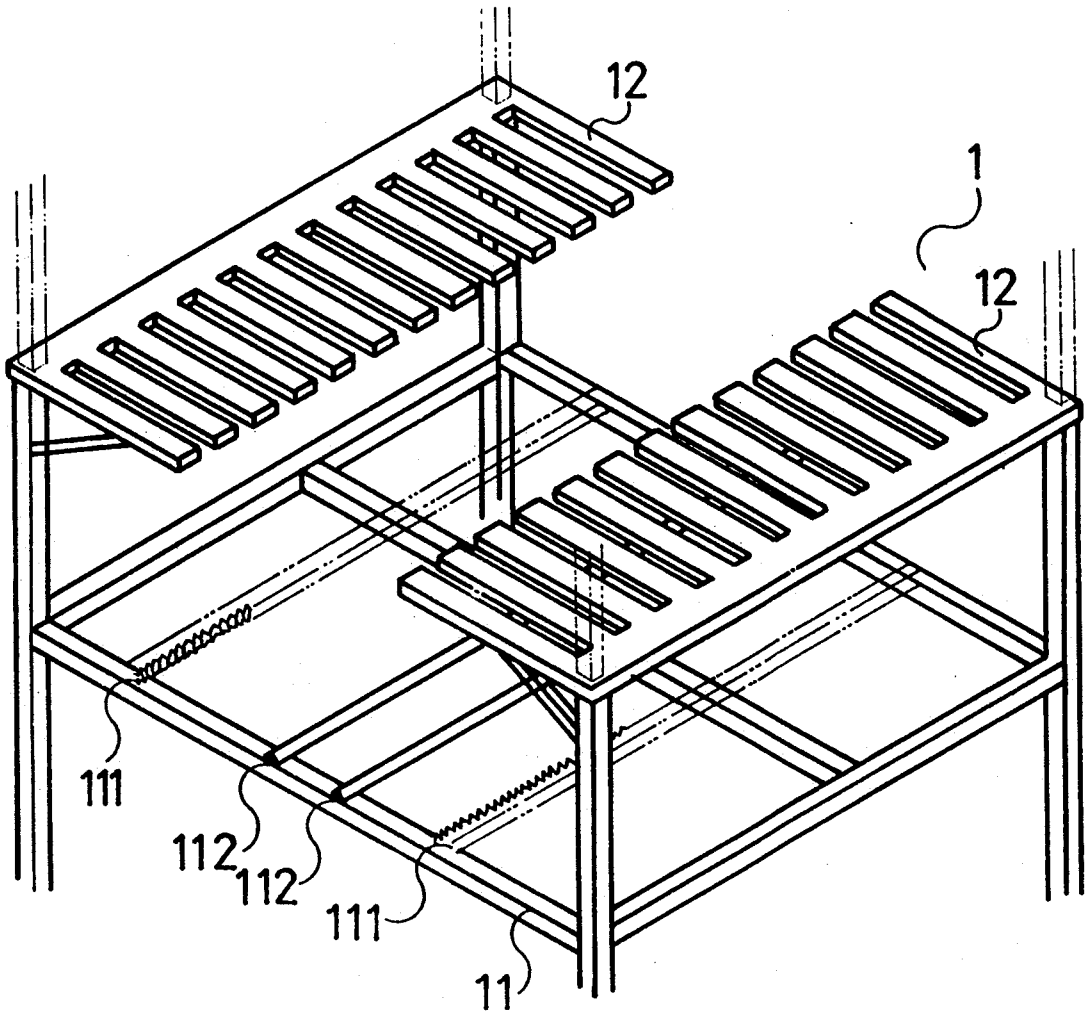
FIG. 1 illustrates a parking rack according to the present invention.

Referring to FIG. 1, a parking rack 1 for parking motorcars according to the present invention is a vertical structure divided into several parking spaces each of which comprises a base frame 11 at the bottom and two opposite comb-like platforms 12 at the top, which base frame 11 has two opposite racks 111 transversely made thereon and a pair of guide rails 112 set therebetween.

Figure 2:
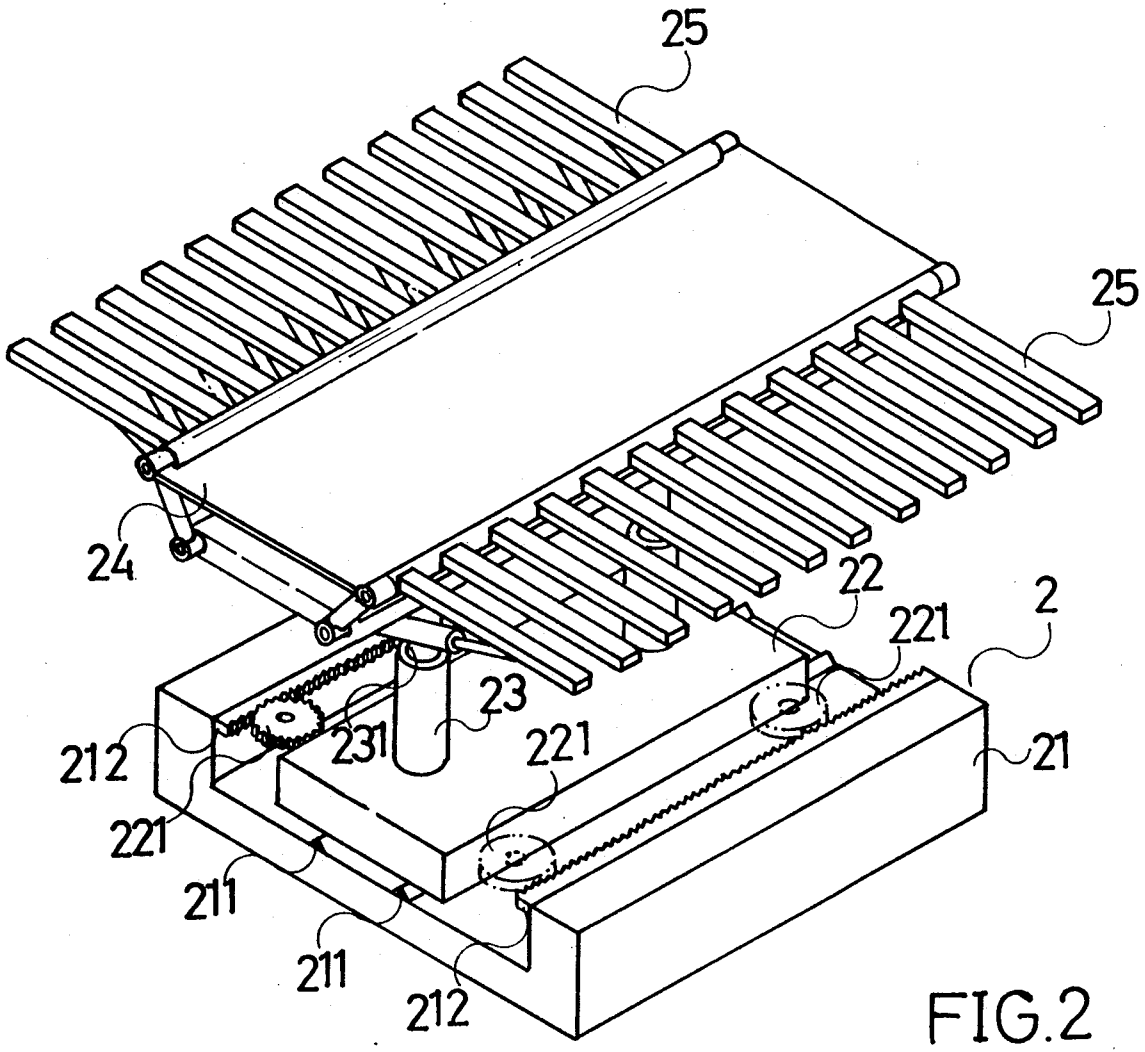
FIG. 2 illustrates a car lifting feeder according to the present invention.
Figure 3:
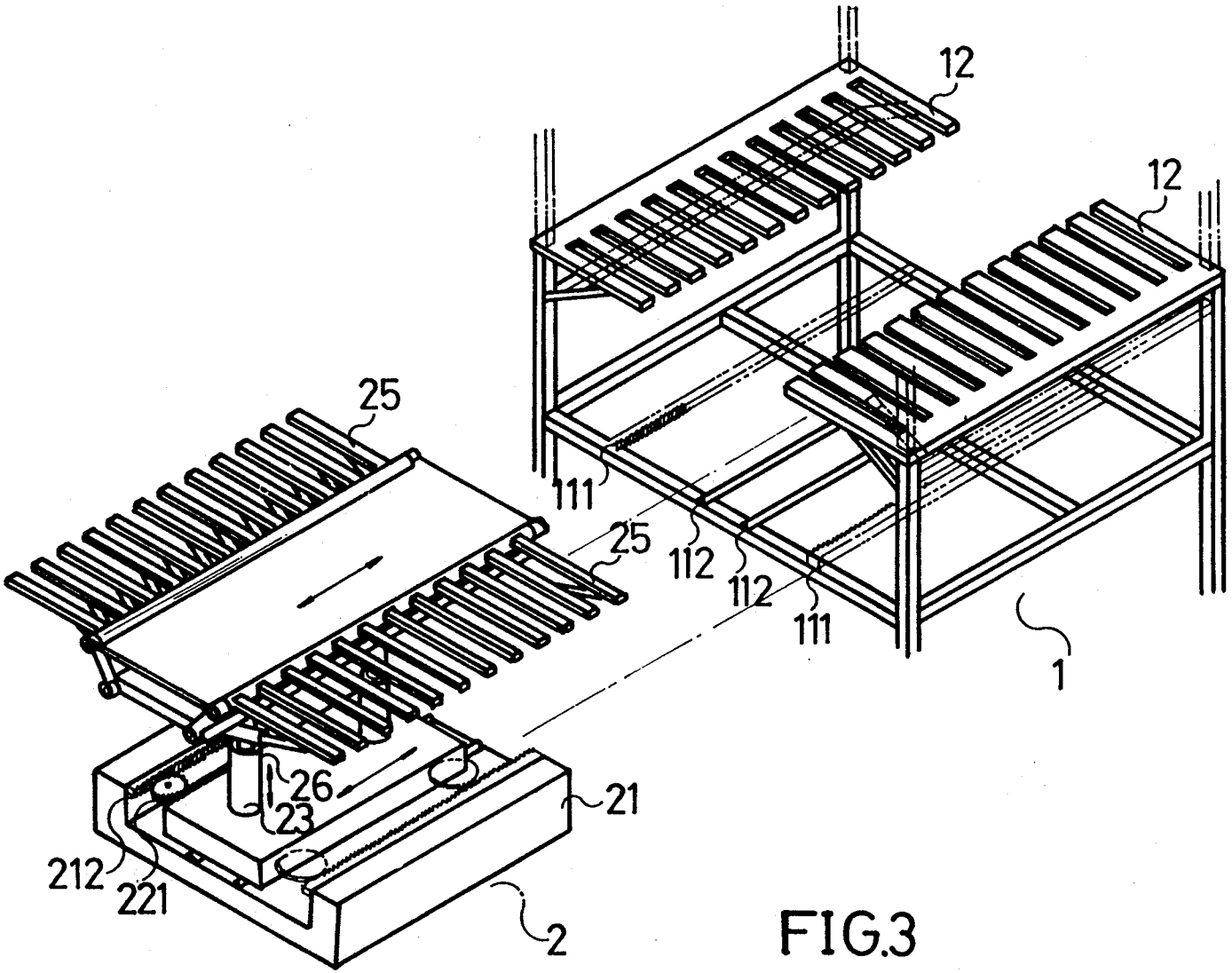
FIG. 3 illustrates the allocation of the parking rack and the car lifting feeder.
Figure 4:
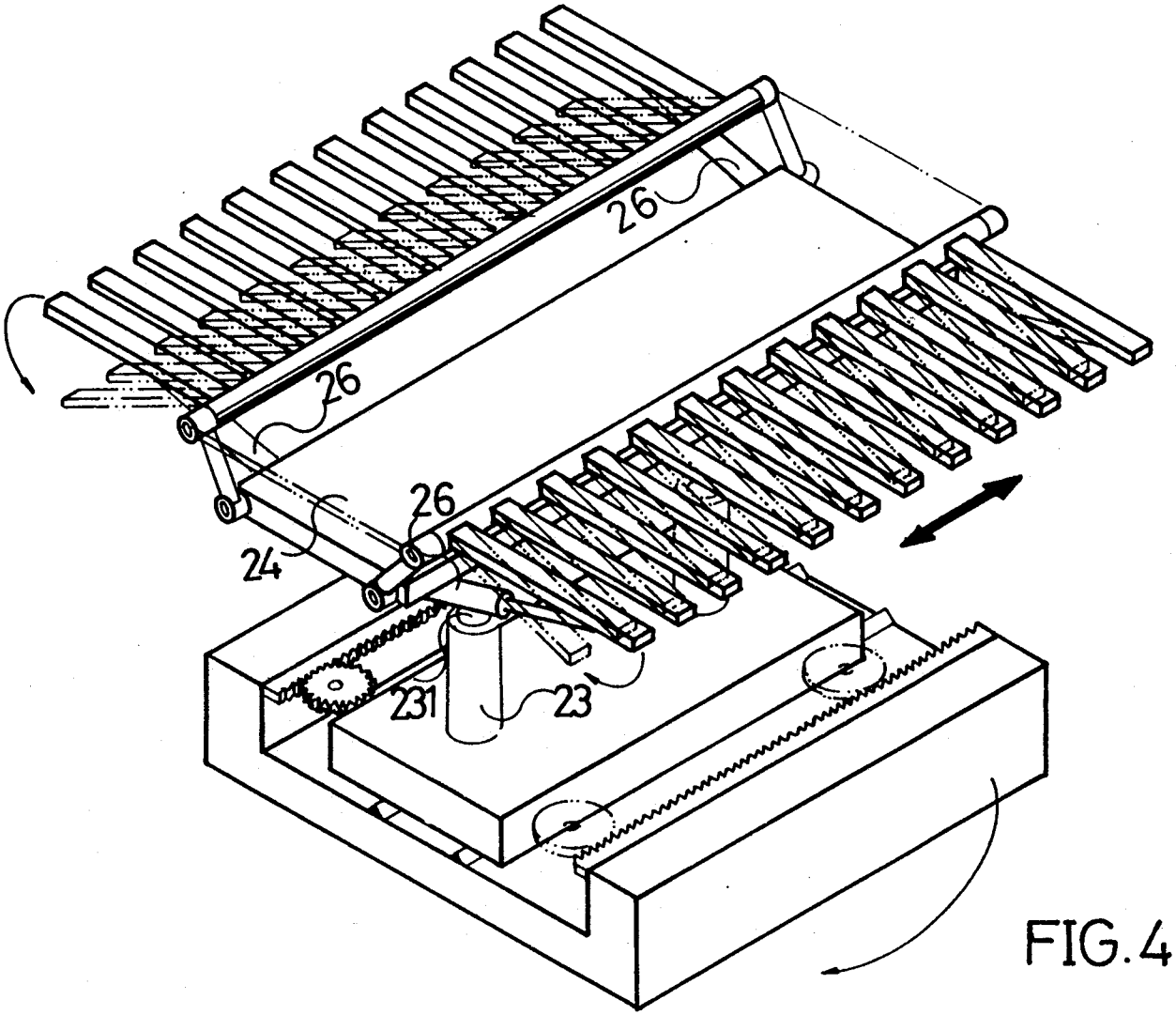
FIG. 4 is a schematic drawing illustrating the operation of the car lifting feeder.
Figure 5:
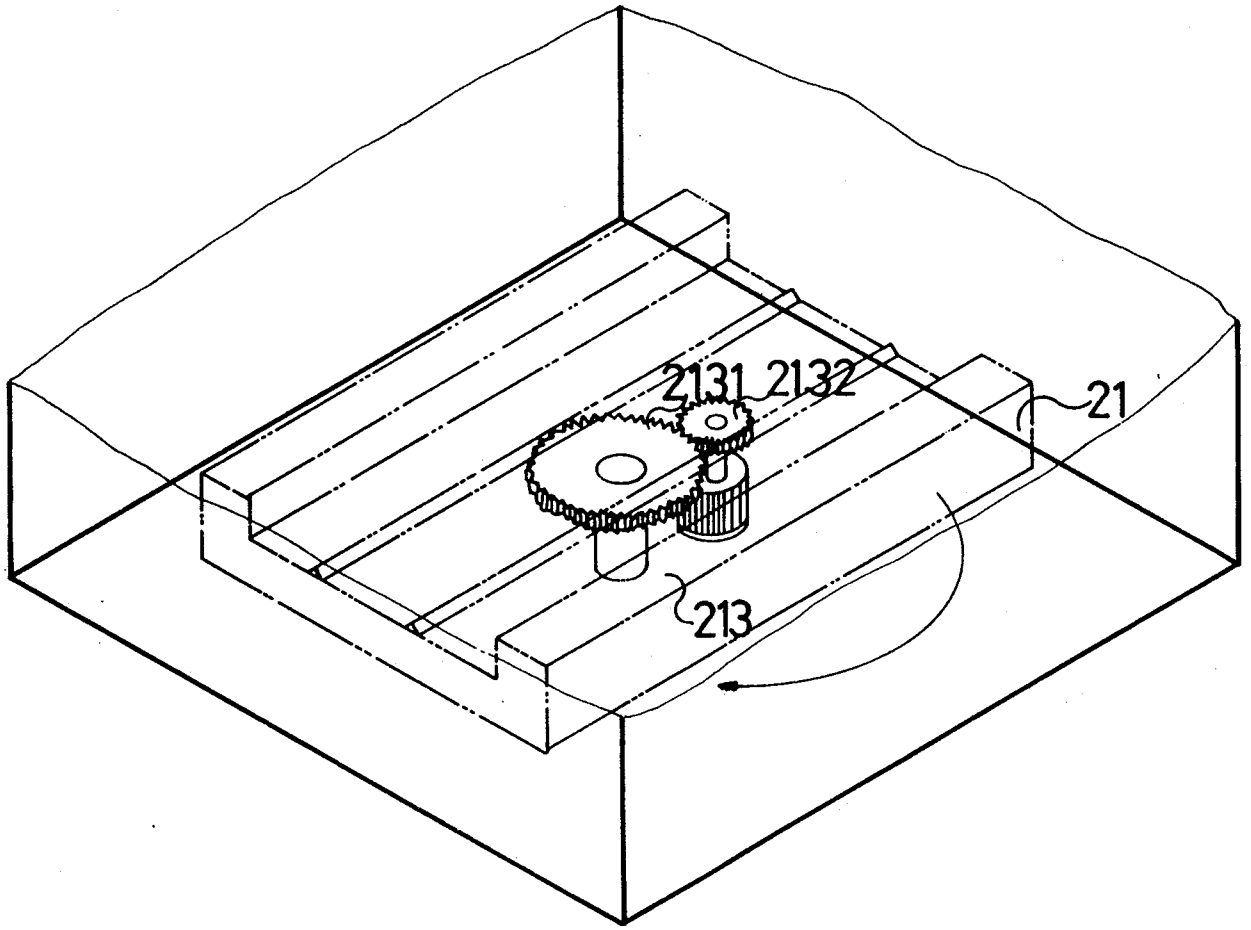
FIG. 5 is a perspective view of the rotary base illustrating the structure of the rotary mechanism therein.
Figure 6:
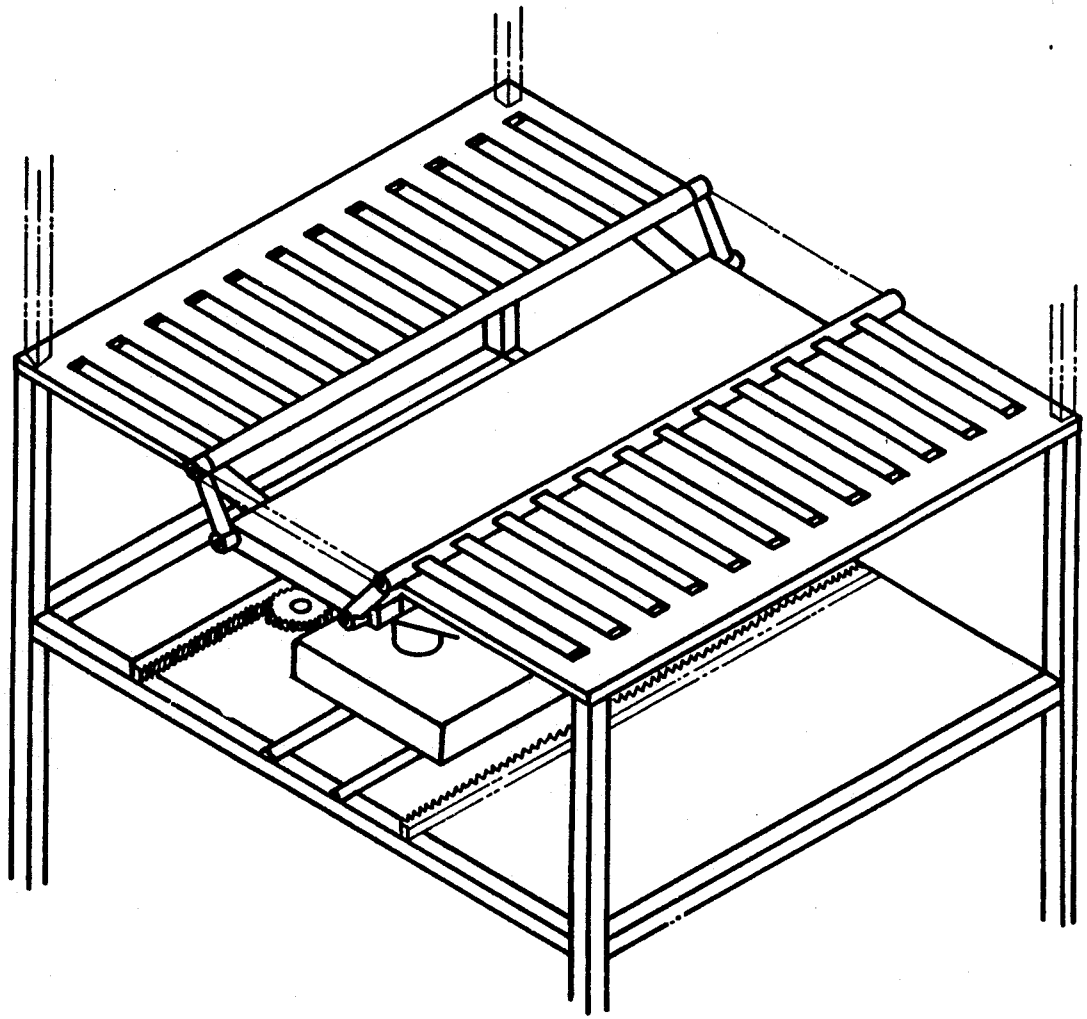
FIG. 6 is a schematic drawing illustrating the engagement of the comb-like platforms of the parking rack with the comb-like wings of the car lifting feeder.

Referring to FIG. 2, a car lifting feeder 2 is designed for lifting and moving motorcars into parking rack. It comprises a rotary base 21 having a pair of guide rails 211 and the middle and a pair of racks 212 at two opposite sides, a sliding seat 22 movably mounted on the guide rails 211 and having gears 221 attached thereto at two opposite sides and respectively engaged with the racks 212, a plurality of hydraulic (pneumatic) cylinders mounted on the sliding seat 22 and having each a reciprocating piston 231 for supporting a platform 24 which has a pair of comb-like wings 25 at two opposite sides driven by respective hydraulic (pneumatic) cylinders 26 to incline downward through a certain degree of angle (see FIG. 4).

Referring to FIGS. 3 through 6, when a car is parked at the comb-like wings 25, the hydraulic (pneumatic) cylinders 23 are started to move the comb-like wings 25 to an empty parking space slightly above the two opposite comb-like platforms 12 of such a parking space. Then, the sliding seat 22 is driven to displace by means of gear power transmission (the engagement of the gears 221 with the racks 212) permitting the sliding seat 22 to slide from the rotary base 21 into the guide rails 112 of the assigned parking space with its gears 221 in engagement with the racks 111 of the assigned parking space of the parking rack 1. Then, the platform 24 (the comb-like wings 25) is moved downward permitting the car to be parked at the two opposite comb-like platforms 12. After parking, the hydraulic (pneumatic) cylinders 26 are started to carry the two comb-like wings to respectively incline downward through a certain degree of angle, and the gears 221 are rotated to move the sliding seat 22 out of the parking rack 1 back to the rotary base 21.

Referring to FIG. 5 again, the rotary base 21 comprises a rotary mechanism 213 so that it can be rotated to carry a car to a desired parking direction. In the present embodiment, the rotary mechanism 213 is comprised of two gear wheels 2131, 2132 respectively engaged with each other.

Figure 7:
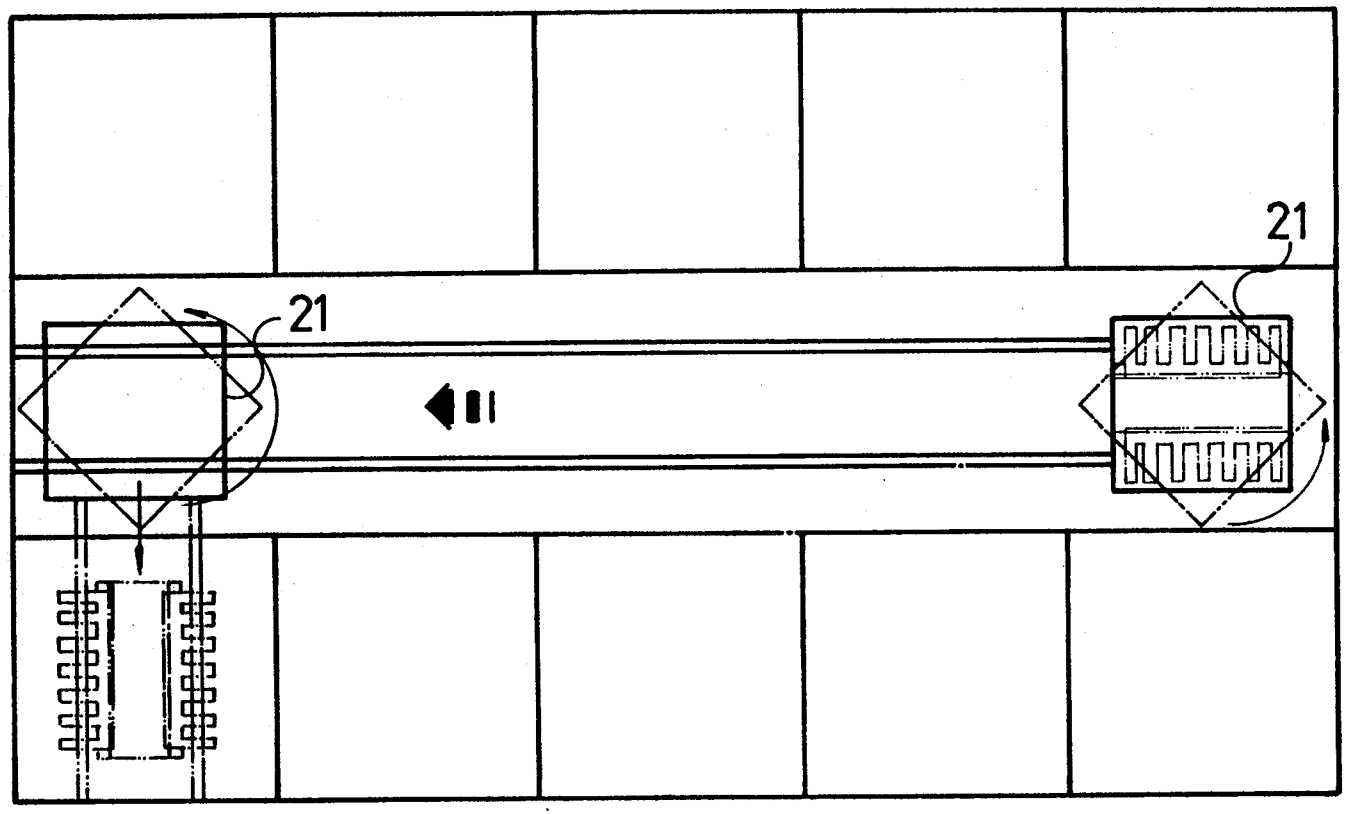
FIG. 7 is a schematic drawing illustrating the operation of the rotary base of the car lifting feeder in the parking rack.

Referring to FIG. 7, by means of the rotation of the rotary base 21 of the car lifting feeder 2, a car can be conveniently parked at a desired parking space.

Figure 8:
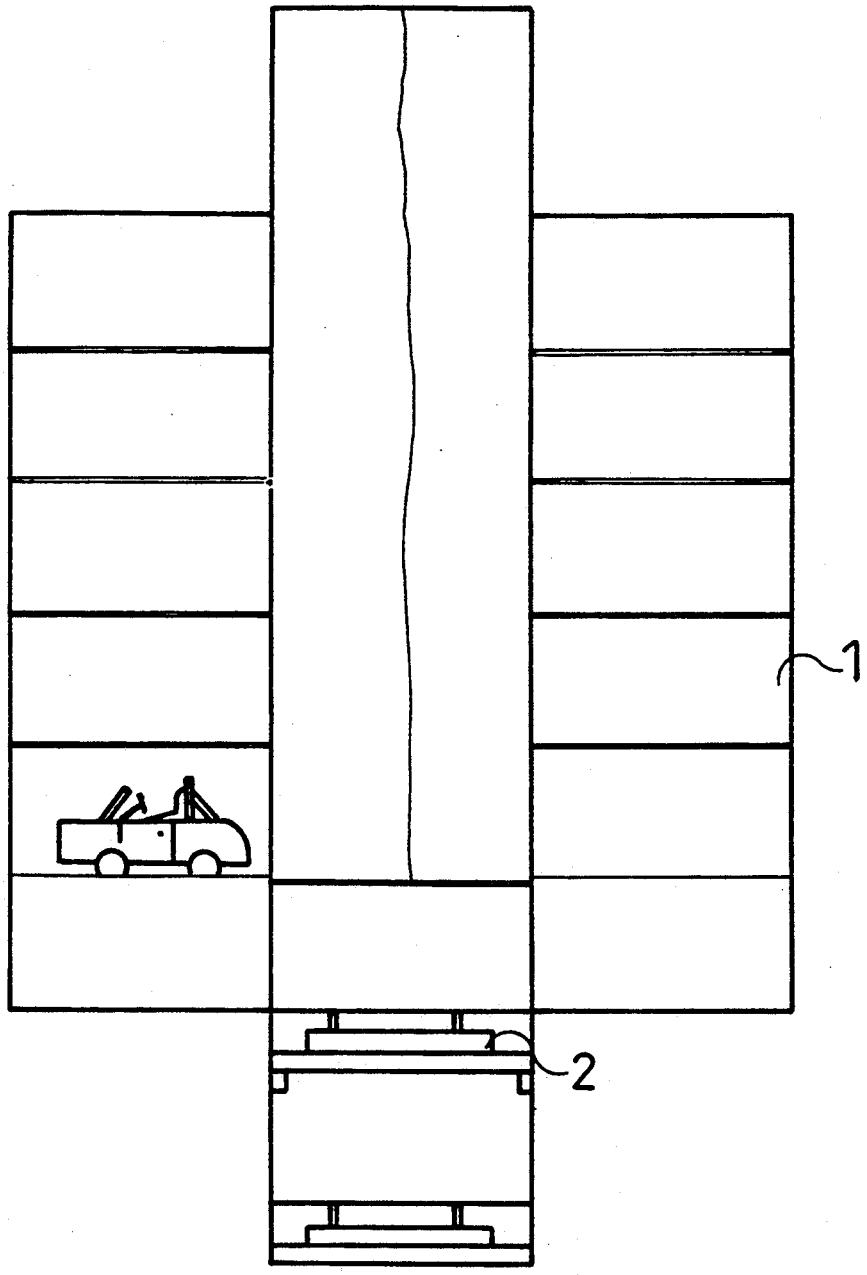
FIG. 8 illustrates the arrangement of two car lifting feeders in a parking rack.
Figure 9:
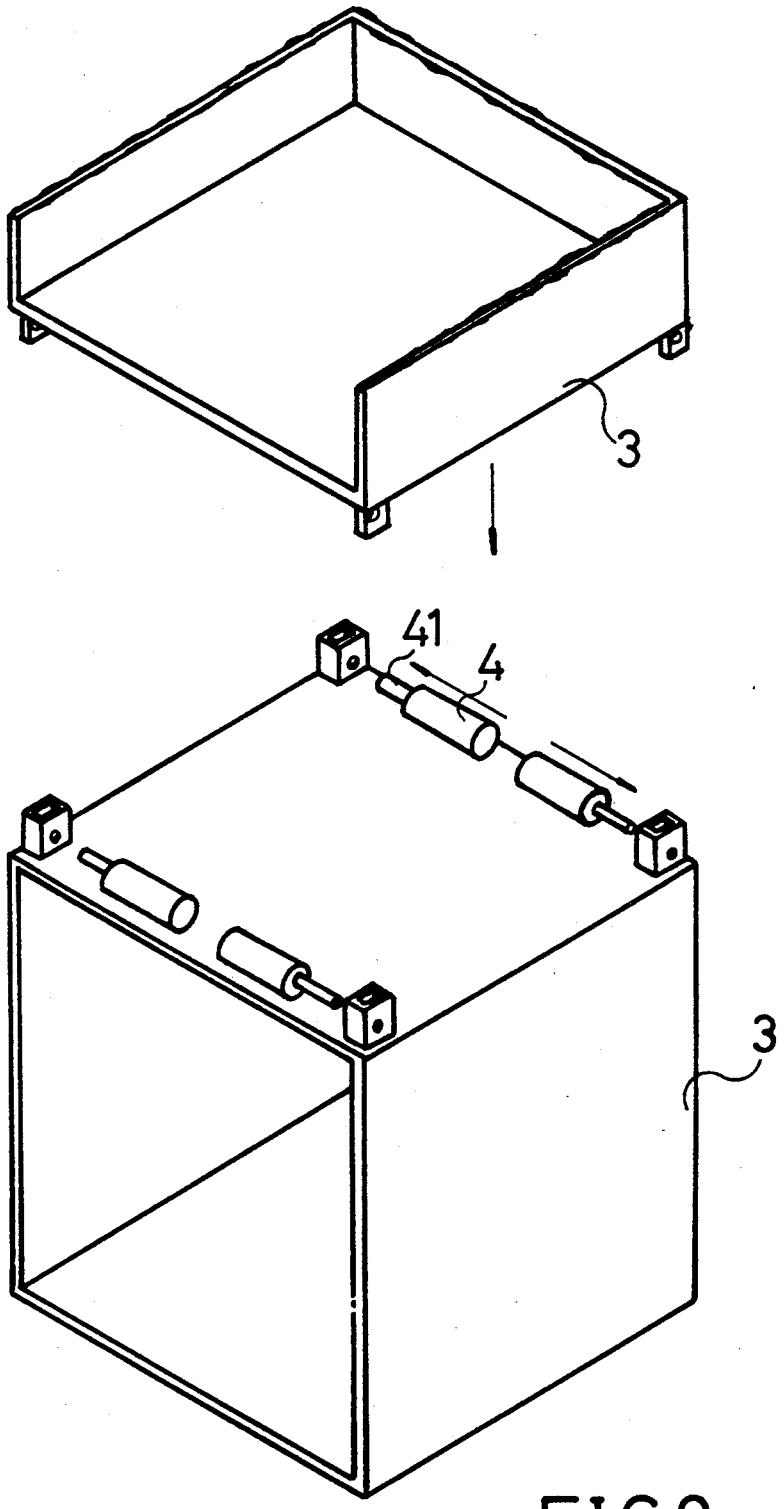
FIG. 9 illustrating the operation to connect the housing of a lower car lifting feeder with the housing of an upper car lifting feeder.

Referring to FIGS. 8 and 9, two sets of car lifting feeders 2 may be installed to match with the parking rack 1. By means of the operation of the reciprocating pistons 41 of the hydraulic (pneumatic) cylinders 4 on the housing 3 of the lower car lifting feeder 2, the upper and lower car lifting feeders 2 can be connected together for parking two cars at the same time or separated from each other for independent operation.

I claim:

1. An automatic car parking system, comprising:

a parking rack system defined therein a plurality of parking spaces each of which comprising a base frame at the bottom and two opposite comb-like platforms at the top, said base frame having two opposite racks transversely made thereon and a pair of guide rails set therebetween; and at least one car lifting feeder for sending a car into said parking spaces, comprising a rotary base having a rotary mechanism therein for rotation, a pair of guide rails at the middle and a pair of racks at two opposite sides, a sliding seat movably mounted on said guide rails and having gears attached thereto at two opposite sides and respectively engaged with the racks of said rotary base, a plurality of power lift cylinders mounted on the sliding seat for carrying a platform to move up and down, and said platform further having a pair of comb-like wings at two opposite sides respectively driven by power tilt cylinders to incline them downward.

2. The automatic car parking system of claim 1, wherein two and more car lifting feeders can be releasably connected in series for carrying a plurality of cars into said parking spaces.

3. The automatic car parking system of claim 1, wherein said rotary mechanism of said rotary base is comprised of two gear wheels engaged together to carry said rotary base to rotate.

* * * * *